US005660191A

United States Patent [19]

Bontoux et al.

[11] Patent Number: 5,660,191

[45] Date of Patent: Aug. 26, 1997

[54] METHOD AND APPLIANCE FOR TREATING AND/OR SHAPING HAIR USING A STEAM DELIVERY TUBE

[75] Inventors: Daniel Bontoux, Saint Genis-Laval; Jean-Pierre Debourg, Lyons, both of France

[73] Assignee: SEB S.A., Selongey, France

[21] Appl. No.: 388,052

[22] Filed: Feb. 6, 1995

[30] Foreign Application Priority Data

Jun. 4, 1993 [FR] France ..... 93 07152

[51] Int. Cl.[6] ..... A45D 7/02

[52] U.S. Cl. ..... 132/211; 132/206; 132/207; 132/210; 132/228; 132/231; 132/232

[58] Field of Search ..... 132/206, 207, 132/210, 211, 228, 229, 230, 231, 232

[56] References Cited

U.S. PATENT DOCUMENTS

| | | | |
|---|---|---|---|
| 1,691,244 | 11/1928 | Hussey | 132/232 |
| 2,258,920 | 10/1941 | Yates | 132/211 |
| 3,921,648 | 11/1975 | Barradas | 132/228 |
| 4,029,110 | 6/1977 | Hyland . | |
| 4,209,685 | 6/1980 | Walter et al. . | |
| 4,260,875 | 4/1981 | Walter et al. | 132/228 |
| 4,341,229 | 7/1982 | Bauer et al. . | |
| 4,419,565 | 12/1983 | McGaw | 132/229 |
| 5,263,501 | 11/1993 | Maznik | 132/228 |

FOREIGN PATENT DOCUMENTS

| | | |
|---|---|---|
| 2 338 670 | 8/1977 | France . |
| WO94/28758 | 12/1994 | WIPO . |

*Primary Examiner*—Gene Mancene
*Assistant Examiner*—Pedro Philogene
*Attorney, Agent, or Firm*—Loeb & Loeb LLP

[57] ABSTRACT

A steam appliance for treating and/or shaping hair, the appliance being composed of: a housing (1) having a handle; a roller body (2) for rolling up locks of hair, the body being secured at one end (5*a*) to the housing and being limited towards its other end by a partition wall (5*b*), the body including holes to pass steam produced by a steam production member and conveyed to the roller body (2) by a steam delivery member (20); and a clamp (10) for clamping a lock of hair on the roller body (2). The steam delivery member is a tubular element (20) mounted coaxially inside and extending along the roller body (2) from an inlet (20*a*) situated in the housing to a terminal end remote from the inlet, the element (20) including at least one steam delivery orifice (21) situated at its terminal end in such a manner as to convey an inlet flow of steam inside the tubular element (20) substantially along its entire length to be released in the vicinity of the partition wall (5*b*) via the orifice (21).

12 Claims, 3 Drawing Sheets

METHOD AND APPLIANCE FOR TREATING AND/OR SHAPING HAIR USING A STEAM DELIVERY TUBE

CROSS-REFERENCE TO RELATED APPLICATION

This application is a continuation of International Application PCT/94/00666, filed Jun. 6, 1994.

TECHNICAL FIELD

The present invention relates to the general technical field of appliances for treating and/or shaping hair, such as appliances suitable for performing the following functions, for example: styling, drying, setting, or curling.

The present invention relates to a steam appliance for treating and/or shaping hair, the appliance comprising a housing with grasping means, a roller body for rolling up locks of hair and mounted on the housing, and projecting from the housing a member for producing steam connected to means for delivering steam that open out in the rolling body, and means such as a clip for clamping a lock of hair on the rolling body.

The appliance of the invention is more particularly designed for performing a function of holding a lock of hair stationary for the purpose of facilitating the curling of said lock. To this end, the appliance of the invention for treating and/or shaping hair relates more specifically, but not exclusively, to curlers. The appliance of the invention may nevertheless naturally include additional devices associated with the housing constituting the appliance and suitable for performing other functions in treating and/or shaping hair, e.g. a brush, or any other means suitable for providing heat, steam, a flow of air, or even a hair treatment product. The appliance of the invention thus also comprises appliances such as combing or curling irons provided with heating means and steam generating means.

PRIOR ART

For the purpose of rolling up and curling a lock of hair, it is already known that use can be made of appliances that include a housing that forms a grasping member such as a handle, said housing being provided or connected to heating means and to means for generating steam and for generating a flow of air. At one end, the housing includes a tube that is pierced through its periphery with a series of orifices through which steam passes. The tube is also associated with a clip that can be moved away from or towards the tube in order to clamp the end of the lock of hair on said tube. The user can then rotate the entire appliance so as to roll the lock around the tube, and then spray steam through the lock. Appliances made on that principle do not give full satisfaction because of the difficulty of handling them which makes rolling up the lock a fiddley operation since it is necessary for rolling up purposes to rotate the entire appliance starting from the grasping means. Such appliances are also generally associated with means for generating a flow of air that is designed to be mixed with the flow of steam, the flow of air coming from the housing. It turns out that the air and the steam mix in a particularly non-uniform manner both around the periphery of the tube and along the longitudinal direction thereof. It is observed that zones of non-uniform mixing are created locally in random manner along the tube, thereby leading to the lock being impregnated in a manner that is likewise non-uniform and uncontrolled. The operating safety of such appliances is also not perfect insofar as the pressure of the steam is relatively high compared with that of the flow of air, so there is a danger of a flow of steam being established that is directed towards the housing and consequently towards the electrical members of the appliance.

A prior art appliance similar to those described above is disclosed in document U.S. Pat. No. 4,029,110. That appliance includes steam generator means mounted on the opposite end of the roller body to the housing. The diffusion of steam through the lock of hair rolled on the roller body is thus not optimally distributed.

Consequently, the object of the invention is to provide a novel steam appliance for treating and/or shaping hair, that is capable of remedying the various drawbacks mentioned above, and in which it is particularly easy to prepare a lock while allowing the lock to be uniformly impregnated with steam, and with this being done in a manner that is entirely safe for the user.

Another object of the invention is to provide a novel steam appliance in which the distribution of steam through the lock of hair is particularly well controlled.

A further object of the invention is to provide a steam appliance in which air/steam mixing is performed in uniform manner.

Another object of the invention is to provide a steam appliance of a design that is simplified and suitable for being implemented at reduced cost.

Another object of the invention is to provide a novel method of treating and/or shaping hair, enabling steam to be distributed uniformly through a lock of hair in complete safety.

SUMMARY OF THE INVENTION

The objects of the invention are achieved by a steam appliance for treating and/or shaping hair, the appliance comprising:

a housing having grasping means;

a roller body for rolling up locks of hair, the body being secured at one end to the housing and being limited towards its other end by a partition wall, said body including holes to pass steam from a steam production member connected to steam delivery means that open out into the roller body; and clamping means for clamping a lock of hair on the roller body;

characterized in that:

the steam delivery means is a tubular element mounted coaxially inside and extending along the roller body from an inlet situated in the housing, said element including at least one steam delivery orifice situated at its terminal end in such a manner as to convey an inlet flow of steam inside the tubular element substantially along its entire length to be released in the vicinity of the partitioning wall via the orifice.

The objects of the invention are also achieved by a method of treating and/or shaping hair, and consisting in:

holding a lock of hair in place between a roller body and means for clamping the lock on said body;

rolling up the hold lock on the roller body; and causing steam to pass from the roller body through the held lock;

characterized in that it further consists in:

conveying the inlet flow of steam without loss to the surroundings towards the end of the roller body and along its longitudinal axis within a coaxial tubular element extending inside the roller body; and releasing the flow of steam in the vicinity of the end of the roller body and directing it towards the lock in the direction opposite to the direction of the inlet flow.

BRIEF DESCRIPTION OF THE DRAWINGS

Other features and advantages of the invention appear and can be seen in greater detail on reading the following description made with reference to the accompanying drawings and given as non-limiting illustrative examples, in which.

BEST METHOD OF PERFORMING THE INVENTION

Figure 1:
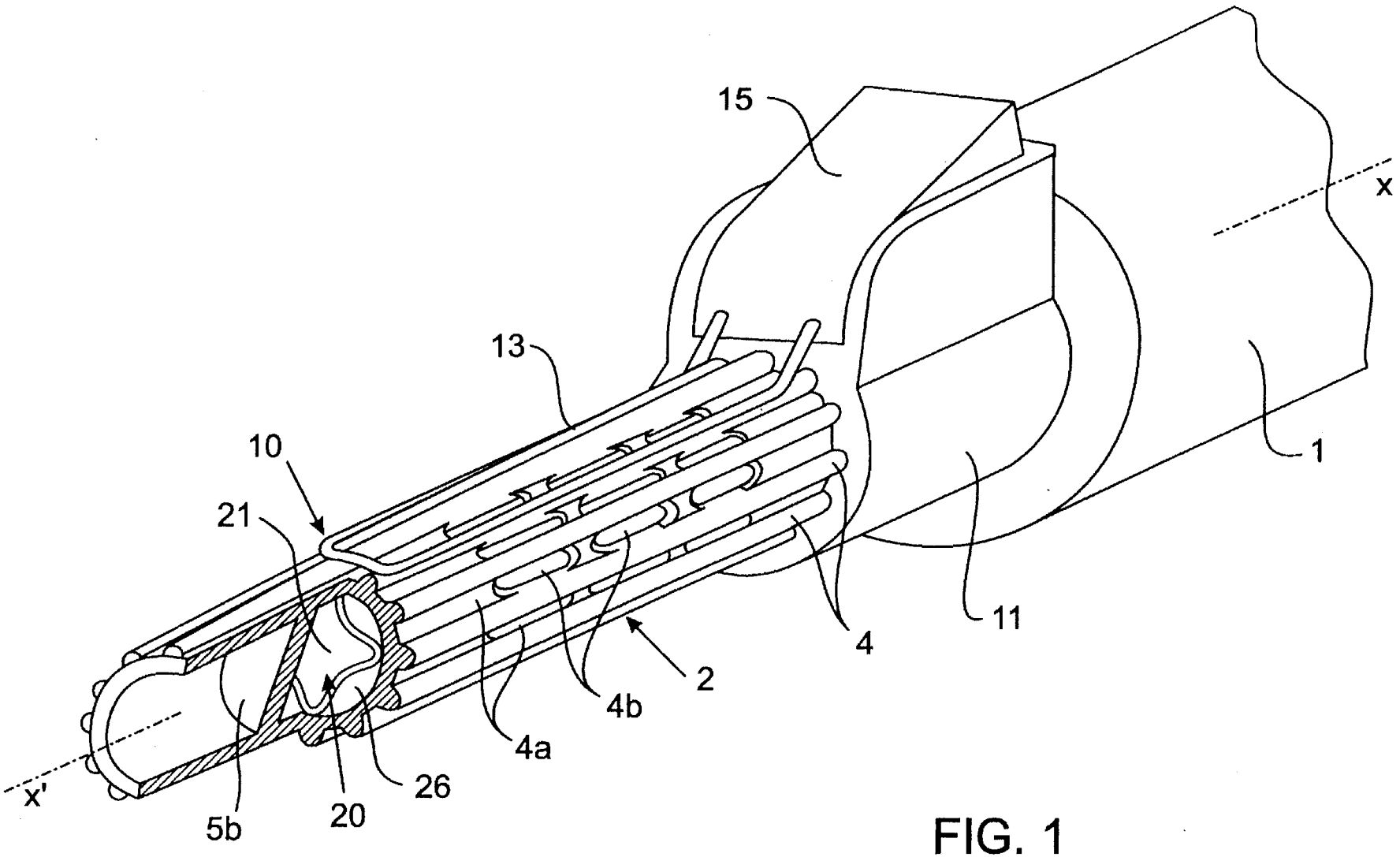
FIG. 1 is a fragmentary perspective view of an appliance of the invention for treating and/or shaping hair.
Figure 2:
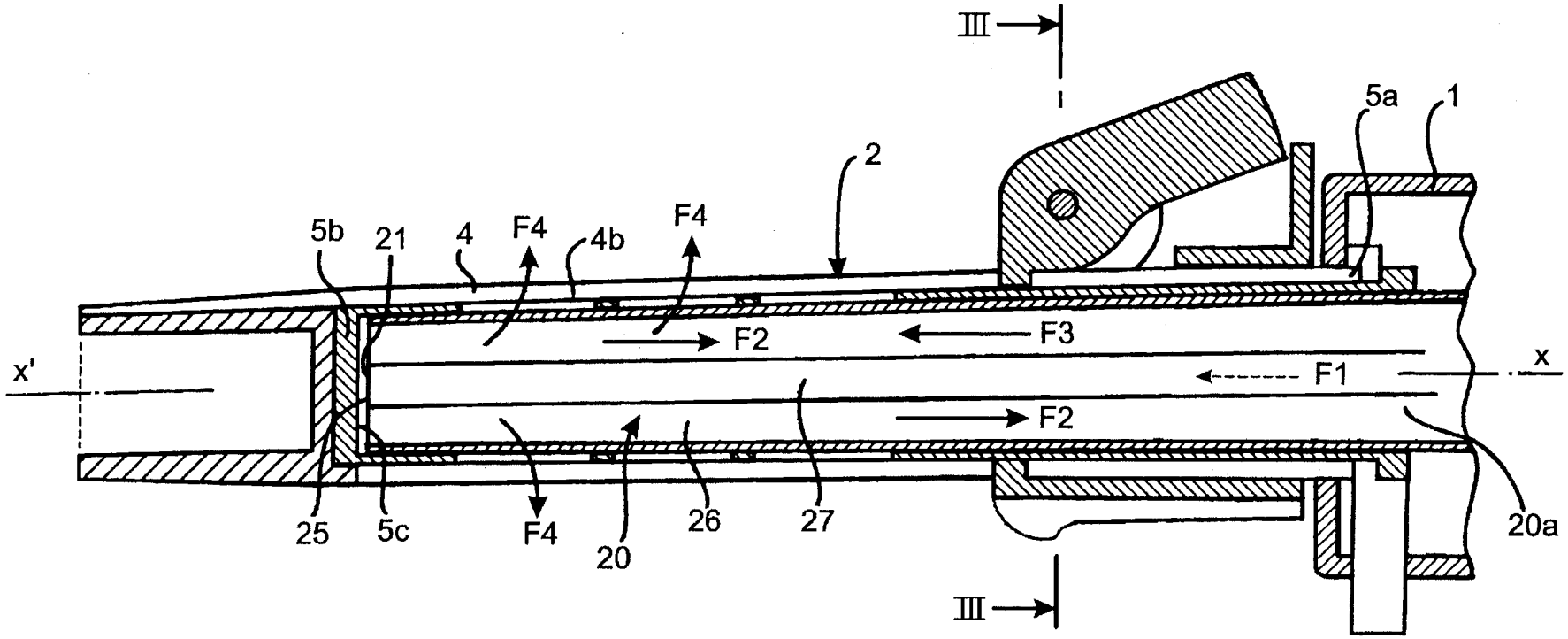
FIG. 2 is a fragmentary longitudinal section through an appliance of the invention for treating and/or shaping hair.
Figure 3:
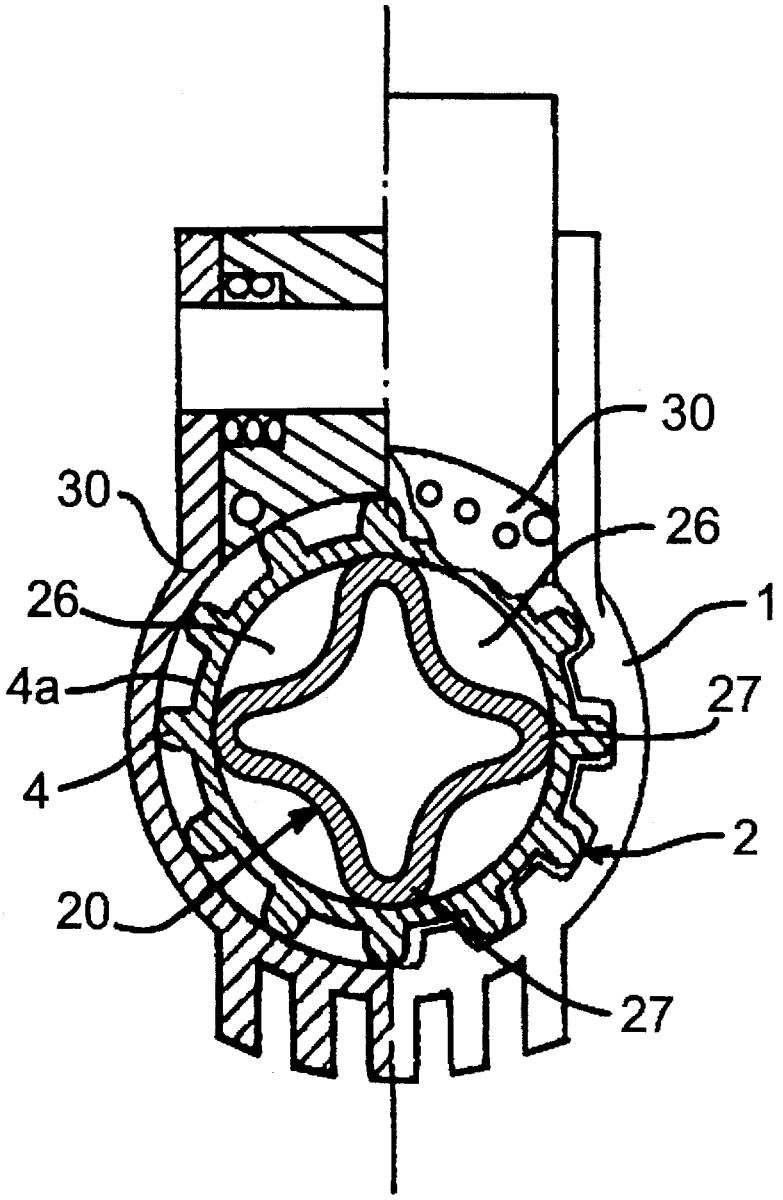
FIG. 3 is a cross-section on line III—III of FIG. 2 through the treatment appliance of the invention.

The steam appliance of the invention for treating and/or shaping hair, such as the curler shown in FIGS. 1 to 3, includes grasping means 1, constituted by a handle that is designed to be held in the hand of the user. In the particular embodiment shown in FIGS. 1 to 3, the grasping means 1 forms the housing of the appliance in which the various component elements thereof are disposed or from which they extend. The grasping means 1 is constituted, for example, by a cylindrical body about an axis of revolution x-x' on which a roller body 2 is advantageously mounted so as to be free to rotate about said axis x-x'. The body is also advantageously cylindrical in shape, being aligned on the axis x-x' and being connected to control means (not shown in the figures) for starting and stopping the rotation of the roller body 2. In the example shown, the control means are constituted by a control button having two positions that lock or release rotation of the roller body 2 about its axis of revolution x-x'. The roller body 2 may also be connected to an electric motor unit capable of driving it in rotation, or it may be fixed relative to the grasping means.

The periphery of the roller body 2 may be provided with a series of ribs 4 that define grooves **4*a* between them to make it easier to attach a lock of hair, or to oppose sliding of the hair while it is being rolled up about the roller body 2. In the example shown, the ribs 4 and the grooves 4*a*** are longitudinal, however it is clear that any type of means suitable for performing an equivalent function could be used.

The roller body 2 is preferably circular in section and it is also provided through its periphery with a series of holes **4*b* running through its thickness and distributed longitudinally along the bottom surfaces of the grooves 4*a***.

The roller body is of hollow and substantially constant section, and it is secured at one end **5*a* to the grasping means 1. Towards its other end it is limited by an internal partition wall 5*b* that constitutes an internal end face 5*c* looking towards the grasping means 1**.

The appliance of the invention for treating and/or shaping hair also includes at least one moving clip 10 designed to clamp the end of a lock of hair on the peripheral surface of the roller body 2. The moving clip 10 is advantageously mounted on the roller body 2 in such a manner as to be freely displaceable therealong. Advantageously, the moving clip 10 is displaceable along the longitudinal axis x-x' of the roller body 2 by means of a slider 11 that is movably mounted on said body. Displacement dynamics could be inverted, with the moving clip 10 being permanently fixed to the housing, while the roller body 2 is displaceable relative to the clip 10.

The moving clip 10 is designed to clamp the end of a lock of hair against the roller body 2 via a compression arm 13 that extends parallel to the axis x-x' and that is designed to bear longitudinally against the periphery of said body.

The end of the clip 10 opposite to its compression arm 13 carries a control knob 15 designed to be actuated manually for the purpose of rotating the clip 10 about a transverse hinge axis (shown in FIG. 2). In conventional manner, the clip 10 is mounted on the slider 11 in association with resilient return means (not shown in the figures), such as a coil or blade spring that urges the compression arm 13 resiliently and continuously to bear against the periphery of the roller body 2.

The steam appliance of the invention also includes a steam producing member (not shown in the figures) such as a steam generator that is internal or external relative to the appliance and that is connected to steam delivery means constituted by a tubular element 20 mounted coaxially inside the roller body 2, extending over substantially the entire length of the roller body 2 starting from an inlet **20*a*** situated inside the housing.

The tubular element 20 is advantageously in fricitional contact with the roller body 2 and in its preferred embodiment as shown in FIGS. 1 to 3, it includes at least one steam delivery orifice 21 situated at its terminal end, and preferably extending over its entire cross-section.

The tubular element 20 extends inside the roller body 2 from the housing and nearly all the way to the wall **5*b*, and it comes to an end at a distance therefrom to leave a manifold chamber 25**.

The steam coming from a tank that may be internal or external to the appliance is consequently conveyed inside the tubular element 20 from its inlet **20*a* in the direction of arrow F1, and escapes via the orifice 21 into the chamber 25 provided between said orifice 21 and the internal end face 5*c* of the roller body 2**.

In a variant, it is possible to make a plurality of orifices 21 along and through the longitudinal envelope of the tubular element 20. In such a variant, the orifices 21 are mostly concentrated near the terminal end of the tubular element 21 that is opposite from its inlet **20*a***.

The cross-section of the tubular element 20 is of a geometrical shape and of dimensions that are appropriate for defining a series of longitudinal recesses 26 between its own outside surface and the inside surface of the roller body 2, the recesses constituting distribution channels running from the terminal end of the tubular element 20 for distributing the steam flow towards the housing.

In the preferred variant shown in FIGS. 1 to 3, the tubular element 20 is constituted by a tube that has been deformed to have at least three and preferably four branches 27 that project radially and that come into frictional contact with the inside surface of the roller body 2. Under such circumstances, the branches 27 support the roller body 2 along at least three and preferably along four generator lines, with the recesses 26 being defined between pairs of adjacent branches 27. Naturally, it is possible for the cross-section of the tubular element to have some other shape, for example it could be triangular in shape, providing enough space is left to ensure that steam flows from the orifice 21 into the manifold chamber 25 and then along the recesses 26.

In another preferred variant of the invention, the housing of the appliance is fitted in such a manner as to include a fan unit (not shown in the figures) suitable for driving a stream of air from the housing and travelling along the recesses 26 in the opposite direction opposite to the travel direction of the flow of steam coming from the manifold chamber 25.

Consequently, the stream of ventilation air flows along the recesses 26 away from the housing towards the terminal end of the tubular element 20 for the purpose of providing uniform air/steam mixing in the recesses 26.

In a further variant of the invention, the stream of ventilation air may include a peripheral annular ventilation section surrounding the roller body 2 and passing through a perforated ring 30 that serves to connect said body to the inside of the housing.

An appliance of the invention operates as follows:

The user takes hold of the appliance in one hand via the grasping means and presses on the knob 15 so as to open the clip 10. This allows a lock of hair to be put into place between the compression arm 13 and the roller body 2, an the lock is then held in place by releasing the knob 15. The user can then rotate the roller body 2 by using the control means so as to cause the lock to be rolled up on the clip 10 and on the roller body 2. The user then puts the steam producing member into operation so as to cause an inlet flow of steam to be generated inside the tubular element 20, passing through the inlet 20*a* in the direction of arrow F1. The inlet flow of steam F1 is thus conveyed without significant loss along the entire length of the tubular element 20, and it escapes to the outside of the appliance near its end via the manifold chamber 25. The inlet flow of steam is then released in the vicinity of the end of the roller body 2 close to the wall 5*b* by passing through the orifice 21, and it is directed along the recesses 26 towards the lock of hair in the direction opposite to the arrows F1, i.e. in the direction F2. Simultaneously, the flow of ventilation air produced in the housing moves along the recesses 26 in the direction of arrow F3 against the flow of released steam. The two flows are therefore constrained to form an air/steam mixture in the recesses 26 immediately before the mixture penetrates into the lock of hair, i.e. before the mixture is expelled through the holes 4*b* in the direction of arrows F4.

The steam appliance and the associated method of the invention consequently enable steam to escape in a zone that is remote from the main electrical members of the appliance, i.e. in a zone that is opposite from the housing, thereby improving the electrical safety of the appliance, with the steam initially being conveyed along the entire length of the roller body 2 and the tubular element 20. This structure also provides an improved heat budget by enabling the steam to come into contact with the tubular element 20 over a path that is elongated since it comprises both the go parth and the return path of the steam along the recesses 26. In addition, by creating a flow of steam and a flow of ventilation air in opposite directions, and by causing those two respective opposite flows to mix within the distribution channels, uniform mixing and distribution of the two flows is achieved in an enclosure that is partially closed and immediately prior to the mixture penetrating into the lock of hair.

This control over the mixing and also over the dynamics of the flows ensures good penetration of the mixture in the lock of hair. In addition, the tubular element 20 is particularly simple to manufacture industrially, since there is no need to pierce the tubular element 20 in the preferred embodiment.

SUITABILITY FOR EXPLOITATION IN INDUSTRY

Exploitation of the invention in industry lies in the manufacture of steam appliances for use in treating and shaping hair, and in particular in the manufacture of steam curling irons.

We claim:

1. A steam appliance for treating and/or shaping hair, the appliance comprising:

a housing (1) having grasping means;

a roller body (2) for rolling up locks of hair, the body being secured at one end (5*a*) to the housing and being limited towards its other end by a partition wall (5*b*), said body including holes to pass steam produced by a steam production member and conveyed to the roller body (2) by steam delivery means (20); and clamping means (10) for clamping a lock of hair on the roller body (2);

characterized in that:

the steam delivery means is a tubular element (20) mounted coaxially inside and extending along the roller body (2) from an inlet (20*a*) situated in the housing to a terminal end remote from the inlet, said element (20) including at least one steam delivery orifice (21) situated at its terminal end in such a manner as to convey an inlet flow of steam inside the tubular element (20) substantially along its entire length to be released in the vicinity of the partition wall (5*b*) via the orifice (21) and to be deflected by the partition wall (5*b*) to the roller body (2).

2. An appliance according to claim 1, characterized in that the steam delivery orifice (21) opens out into a manifold chamber (25) provided between said terminal end and the internal partition wall (5*b*).

3. An appliance according to claim 1, characterized in that the tubular element (20) and the inside surface of the roller body (2) co-operate to define a series of longitudinal recesses (26) forming steam flow distributing channels extending from the orifice (21).

4. An appliance according to claim 3, characterized in that the recesses (26) extend from the terminal end of the tubular element (20).

5. An appliance according to claim 4, characterized in that the roller body (2) has an internal surface of circular form.

6. An appliance according to claim 5, characterized in that the tubular element (20 ) has a longitudinal axis and is formed by a deformed tube having at least three branches (27), the branches supporting the roller body (2) along at least three lines that are parallel to the longitudinal axis, the recesses (26) being defined between pairs of adjacent branches (27).

7. An appliance according to claim 1, characterized in that the roller body (2) is provided on the outside with longitudinal ribs (4) and grooves (4*a*) having the holes (4*b*) formed therein, the grooves alternating with the ribs.

8. An appliance according to claim 1, characterized in that the roller body (2) is mounted to rotate freely on the housing about its longitudinal axis and about the tubular element (20).

9. An appliance according to claim 1, characterized in that the appliance further comprises a fan unit suitable for creating a stream of air running in the opposite direction to the direction from the terminal end to the inlet of the tubular element.

10. An appliance according to claim 9, characterized in that the tubular element (20) and the inside surface of the roller body (2) co-operate to define a series of longitudinal recesses (26) wherein the stream of air flows from the housing and towards the terminal end of the tubular element (20) so as to perform air/steam mixing in said recesses.

11. A method of treating and/or shaping hair, said method comprising:

holding a lock of hair in place between a roller body and means for clamping the lock against the body, the roller body having axially opposed first and second ends;

rolling up the held lock on the roller body;

conveying steam within the roller body over an enclosed path from the first end to the second end;

deflecting the steam at the second end for causing the steam to flow from the second end toward the first end over a second path; and releasing the steam from the second path into the lock at a location between the first and second ends.

12. A method according to claim 11 further comprising: producing a flow of air from the first end toward the second end; and causing the air to mix with steam that is flowing along the second path in order to form an air/steam mixture, wherein said step of releasing is performed by directing the mixture into the lock.

* * * * *